US009663273B2

(12) United States Patent
Park et al.

(10) Patent No.: US 9,663,273 B2
(45) Date of Patent: May 30, 2017

(54) CONTAINER CAP

(75) Inventors: Kwang Soo Park, Seoul (KR); Byung Kook Lee, Seoul (KR); Min Seok Choi, Seoul (KR)

(73) Assignee: CJ CHEILJEDANG CORPORATION, Seoul (KR)

( * ) Notice: Subject to any disclaimer, the term of this patent is extended or adjusted under 35 U.S.C. 154(b) by 0 days.

(21) Appl. No.: 14/000,822

(22) PCT Filed: Feb. 14, 2012

(86) PCT No.: PCT/KR2012/001098

§ 371 (c)(1),
(2), (4) Date: Aug. 21, 2013

(87) PCT Pub. No.: WO2012/115381

PCT Pub. Date: Aug. 30, 2012

(65) Prior Publication Data

US 2013/0327772 A1 Dec. 12, 2013

(30) Foreign Application Priority Data

Feb. 22, 2011 (KR) ..... 20-2011-0001482 U

(51) Int. Cl.
*B65D 47/12* (2006.01)
*B65D 41/04* (2006.01)
(Continued)

(52) U.S. Cl.
CPC ..... *B65D 41/0485* (2013.01); *B65D 47/063* (2013.01); *B65D 47/122* (2013.01); *B65D 47/36* (2013.01); *B65D 51/242* (2013.01)

(58) Field of Classification Search
CPC .. B65D 47/36; B65D 51/242; B65D 41/0485; B65D 47/122; B65D 47/061; B65D 47/063; B65D 39/16
(Continued)

(56) References Cited

U.S. PATENT DOCUMENTS 2,138,537 A * 11/1938 Bernat ..... A01J 9/00 220/212.5
4,422,563 A * 12/1983 Babiol ..... B65D 47/063 222/153.09
(Continued)

FOREIGN PATENT DOCUMENTS

KR 20-1994-0006476 Y1 9/1994
KR 20-2000-0004638 3/2000
(Continued)

OTHER PUBLICATIONS

International Search Report, mailed Sep. 26, 2012, issued in corresponding International Patent Application U.S. Appl. No. PCT/KR2012/001098.
(Continued)

*Primary Examiner* — James N Smalley
(74) *Attorney, Agent, or Firm* — Stein IP, LLC

(57) ABSTRACT

A container cap according to the present invention includes a lower cap combined with a container and comprising an opening communicating with an inside of the container; and an upper cap combined with the lower cap to cover the opening. Further, the upper cap includes a cover covering the opening; a rim provided around the cover and partly connected to the cover; a connection part connecting the rim and the cover; and a handle connected to the rim and having a round shape, which curves outwards from a center of the cover, viewed on a plane.

11 Claims, 6 Drawing Sheets

(51) Int. Cl.
*B65D 47/06* (2006.01)
*B65D 47/36* (2006.01)
*B65D 51/24* (2006.01)

(58) Field of Classification Search
USPC ..... 220/258.1, 258.2, 212.5; 222/153.07, 222/529; 215/305
See application file for complete search history.

(56) References Cited

U.S. PATENT DOCUMENTS

| | | | | |
|---|---|---|---|---|
| 5,190,181 | A | 3/1993 | Budenbender | 220/288 |
| 5,899,364 | A * | 5/1999 | McLelland | B29C 45/14418 222/153.06 |
| 7,988,007 | B2 | 8/2011 | Baughman et al. | 220/212.5 |
| 2004/0200797 | A1 * | 10/2004 | Hicks | B65D 41/0421 215/305 |
| 2006/0186122 | A1 | 8/2006 | Lin | 220/288 |
| 2008/0296301 | A1 * | 12/2008 | Baughman et al. | 220/289 |

FOREIGN PATENT DOCUMENTS

| | | | |
|---|---|---|---|
| KR | 20-0241932 | Y1 | 2/2002 |
| KR | 20-0324202 | Y1 | 8/2003 |
| KR | 10-2008-0074276 | A | 8/2008 |
| KR | 10-0863424 | B1 | 10/2008 |
| KR | 10-2010-0117917 | A | 11/2010 |

OTHER PUBLICATIONS

Search Report and written Opinion dated Apr. 30, 2015, issued to Korean Application No. 10201408216P.
Filipino Office Action dated Jun. 17, 2016, issued by the Intellectual Property Office of the Philippines in corresponding application 1/2013/501731.

* cited by examiner

CONTAINER CAP

CROSS-REFERENCE TO RELATED APPLICATIONS

This application is a national stage application of International Application No. PCT/KR2012/001098, filed Feb. 14, 2012, which claims benefit of Korean Application No. 20-2011-0001482, filed Feb. 22, 2011. All disclosures of the document(s) named above are incorporated herein by reference.

BACKGROUND OF THE INVENTION

1. Field of the Invention

The present invention relates to a container cap and more particularly to a container cap which is easy for a user to open and close and has a simple structure of discharging contents stored in a container.

2. Description of the Related Art

A container cap is combined with a discharge hole of a container to seal up materials stored in the container when the container cap is closed. Also, when the container cap is open, a user can discharge the materials out of the container through an opening formed in the container cap.

SUMMARY OF THE INVENTION

Technical Goals

An aspect of the present invention provides a container cap which is easy for a user to open and close and has a simple structure of discharging contents stored in a container.

Technical Solutions

According to an aspect of the present invention, there is provided a container cap including a lower cap and an upper cap. The lower cap is combined with a container and includes an opening communicating with an inside of the container, and the upper cap is combined with the lower cap to cover the opening.

Further, the upper cap includes a cover, a rim and a handle. The cover covers the opening, and the rim is provided around the cover and partly connected to the cover. The connection part connects the rim and the cover, and the handle is connected to the rim and has a round shape, which curves outwards from a center of the cover, viewed on a plane.

Also, the lower cap includes a cut part formed with the opening; a second coupling part surrounding the cut part and combined with a first coupling part; a packing part combined with a discharge hole of the container and providing a space into which the first coupling part is inserted; and an auxiliary packing part facing the packing part with the discharge hole of the container disposed therebetween.

According to another embodiment of the present invention, the auxiliary packing part includes holes defined by partly removing the auxiliary packing part.

Advantageous Effects

According to a container cap of the present invention, a handle is provided in an upper cap, so that a user conveniently combines the upper cap with a lower cap or detaches the upper cap from the lower cap. Further, a width of an open side of the opening of the lower cap is designed to be narrower toward one side, thereby minimizing a remaining amount of materials in a container when discharging materials out of the container.

In addition, as holes are formed in an auxiliary packing part of the lower cap, contents stored in the container outside smoothly move around the lower cap due to the holes when turning the container upside down to discharge the contents, thereby facilitating discharge of the contents out of the container.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
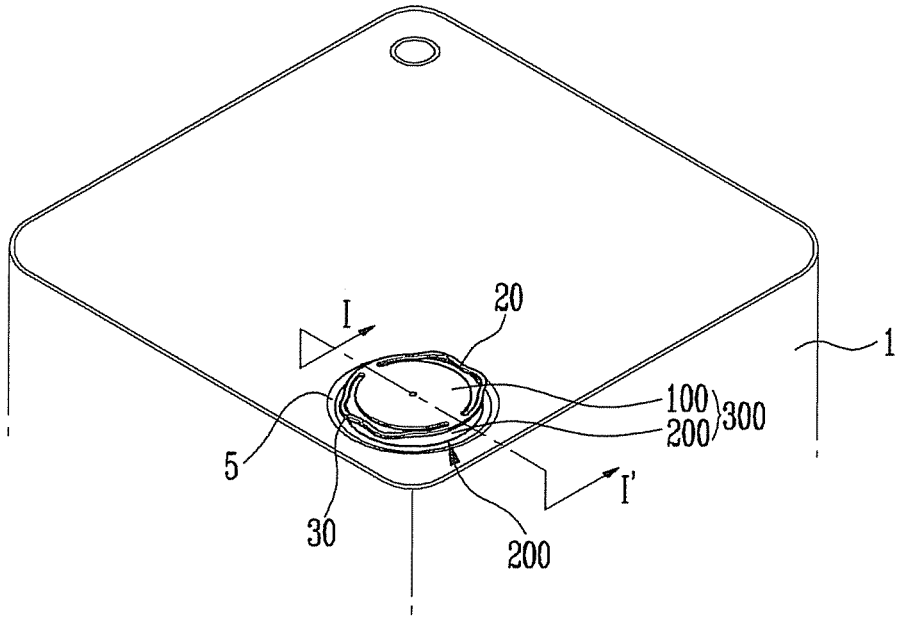
FIG. 1 is a perspective view illustrating a container cap combined with a container according to an embodiment of the present invention.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

FIG. 1 is a perspective view illustrating a container cap combined with a container according to an embodiment of the present invention.

Referring to FIG. 1, the container cap 300 is combined with a discharge hole 5 of a container 1. In the embodiment of the present invention, the container cap 300 may be used as a cap of a container which stores liquid materials, such as cooking oil, and has a high capacity of about 18-L.

Figure 4:
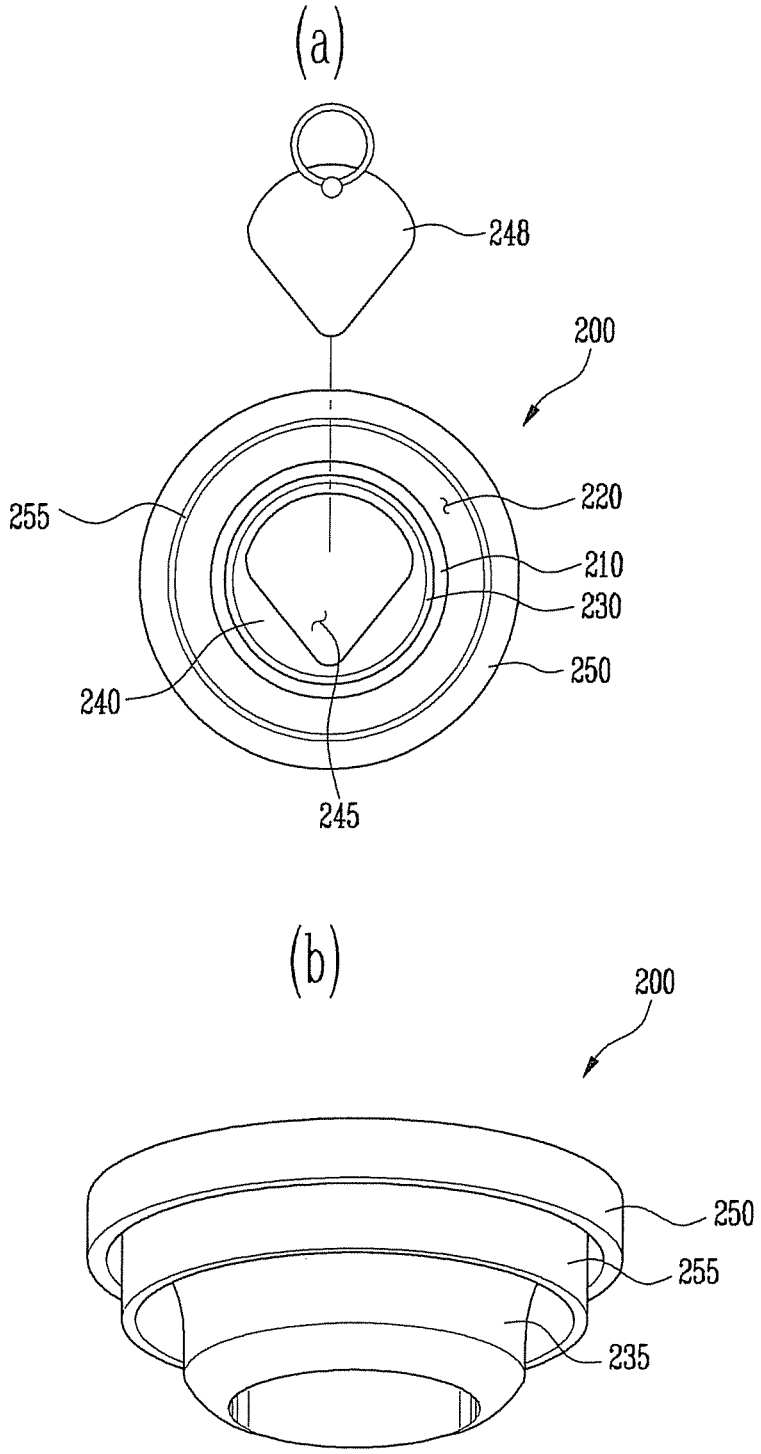
FIG. 4A is a plan view of a lower cap of the container cap shown in FIG. 1.
FIG. 4B is a perspective view of the lower cap of the container cap shown in FIG. 1.

The container cap 300 includes an upper cap 100 and a lower cap 200 combined with the upper cap 100. The lower cap 200 is combined with the container 1 to cover the discharge hole 5 and includes an opening 245 (FIG. 4A) formed therein, so that materials stored in the container 1 may be provided out of the container 1 via the discharge hole 5 and then the opening 245.

The upper cap 100 is combined with the lower cap 200 to cover the opening of the lower cap 200. In the embodiment of the present invention, the upper cap 100 and the lower cap 200 may be combined with each other by screw threads formed on the upper cap 100 and the lower cap 200.

Meanwhile, to conveniently handle the upper cap 100 when detaching the upper cap 100 from the lower cap 200, the upper cap 100 includes a first handle 20 and a second handle 30. A structure of the upper cap 100 will be described in detail with reference to FIGS. 2 and 3, and a structure of the lower cap 200 will be described in detail with reference to FIGS. 4A, 4B and 5.

Figure 2:
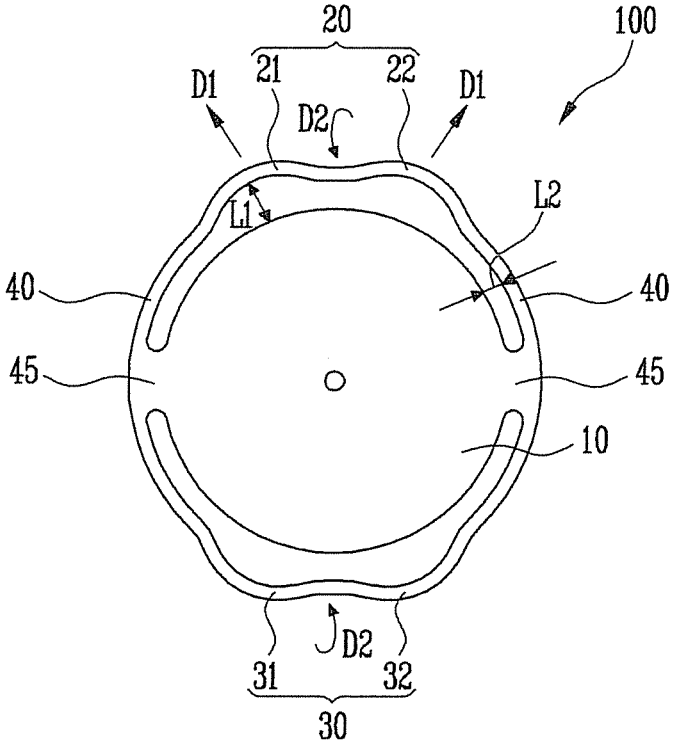
FIG. 2 is a plan view of an upper cap of the container cap shown in FIG. 1.
Figure 3:
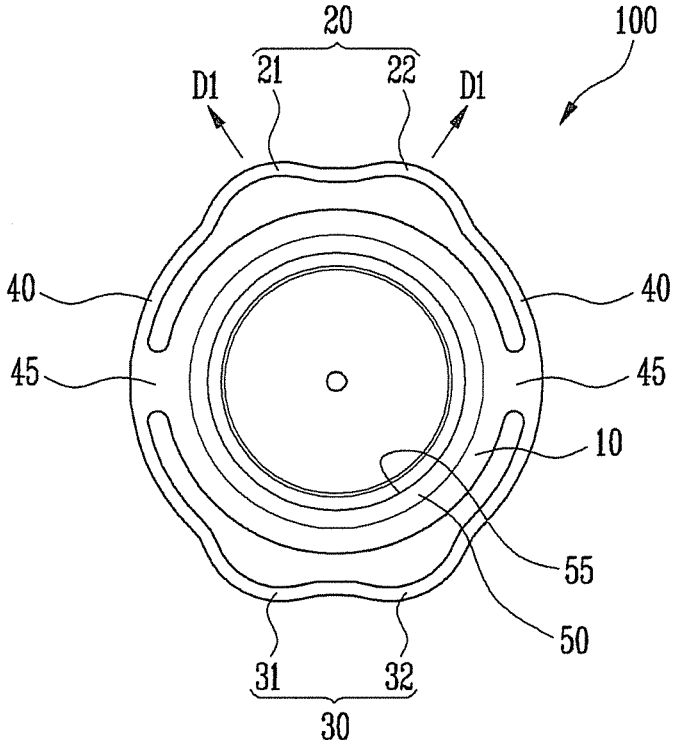
FIG. 3 is a base view of the upper cap of the container cap shown in FIG. 1.

FIG. 2 is a plan view of the upper cap of the container cap shown in FIG. 1, and FIG. 3 is a base view of the upper cap of the container cap shown in FIG. 1.

Referring to FIGS. 2 and 3, the upper cap 100 includes a cover 10, a rim 40, connection parts 45, a first coupling part 50, a first screw thread 55, a first handle 20, and a second handle 30.

The cover 10 covers the opening of the lower cap 200 (FIG. 1) and has a size schematically corresponding to a size of the discharge hole 5 (FIG. 1).

Figure 5:
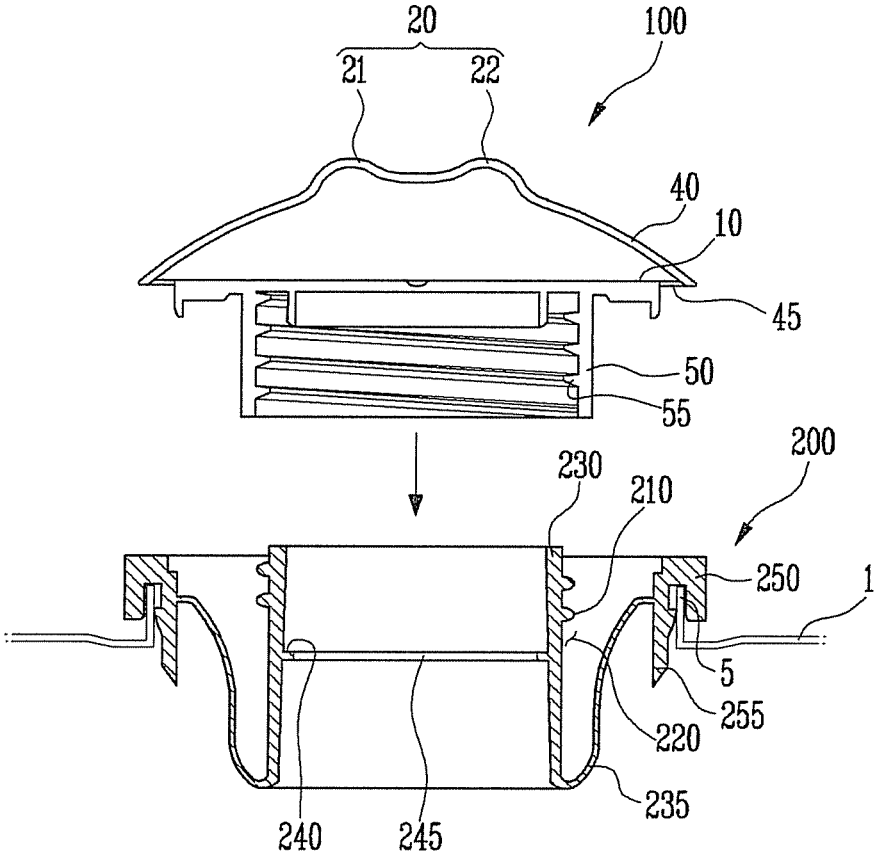
FIG. 5 is a cross-sectional view illustrating a section, taken along line I'-I' shown in FIG. 1.

The rim 40 is provided around the cover 10 and partly connected to the cover 10 by the connection parts 45. Further, the first coupling part 50, as shown in FIG. 5, extends from a lower part of the cover 10 and includes the first screw thread 55 formed on an internal wall thereof. Thus, the upper cap 100 may be combined with the lower cap 200 (FIG. 1) by the first screw thread 55.

The first handle 20 and the second handle 30 are connected to the rim 40, facing each other. In the embodiment of the present invention, the first handle 20 and the second handle 30 may be formed in a single body with the rim 40, and each of the first handle 20 and the second handle 30 includes two convex parts with a round shape, which curve outwards in a first direction D1 from a center of the cover 10, viewed on a plane.

In detail, the first handle 20 includes a first convex part 21 and a second convex part 22 adjacent to the first convex part 21, and the second handle 30 includes a third convex part 31 and a fourth convex part 32 adjacent to the third convex part 31. In structures of the first handle 20 and the second handle 30, a first distance L1 between each of the first to fourth convex parts 21, 22, 31 and 32 and the cover 10 is longer than a second distance L2 between the rim 40 and the cover 10.

Meanwhile, the rim 40, the first handle 20, and the second handle 30 are partly connected to the cover 10 by the connection parts 45. Thus, as shown in FIG. 5, the rim 40, the first handle 20, and the second handle 30 may be bent in a second direction D2 on the connection parts 45 as an axis to slant to the cover 10. Accordingly, when the upper cap 100 is detached from the lower cap 200 (FIG. 1), a user can grip the bent first and second handles 20 and 30 to conveniently handle the upper cap 100.

Further, when a user grips the first and second handles 20 and 30, the user may have fingers conveniently supporting round portions of the respective first to fourth convex parts 31, 32, 41 and 42, and thus the user may simply handle the upper cap 100.

Meanwhile, as described above, when the rim 40, the first handle 20 and the second handle 30 are bent in the second direction (D2) on the connection parts 45 as an axis, it is preferable that the first and second handles 20 and 30 face each other and any one of the connection parts 45 is positioned opposite to the other connection part 45 between the first handle 20 and the second handle 30 so as to easily grip the first and second handles 20 and 30.

FIG. 4A is a plan view of the lower cap of the container cap shown in FIG. 1, FIG. 4B is a perspective view of the lower cap of the container cap shown in FIG. 1, and FIG. 5 is a cross-sectional view illustrating a section, taken along line I'-I' shown in FIG. 1.

Referring to FIGS. 4A, 4B and 5, the lower cap 200 includes a cut part 240, a second coupling part 230, a second screw thread 210, a covering part 248, a lower connection part 235, an auxiliary packing part 255 and a packing part 250.

In the cut part 240 is formed an opening 245 through which materials stored in the container 1 is discharged. The second coupling part 230 surrounds the cut part 240, and the second screw thread 210 is provided on an outside of the second coupling part 230.

Further, the packing part 250 is combined with the discharge hole of the container 1 and is spaced away from the second coupling part 230 to provide an insertion hole 220 into which the first coupling part 50 is inserted. Thus, in the state that the lower cap 200 is combined with the discharge hole 5 of the container 1, a user inserts the upper cap 100 into the insertion hole 220 so that the first coupling part 50 is disposed between the packing part 250 and the second coupling part 230, and the user rotates the upper cap 100 to combine the upper cap 100 with the second cap 200 using fastening force between the first and second screw threads 55 and 210.

Meanwhile, before using the lower cap 200, the cut part 240 and the covering part 248 may be formed in a single body, and the opening 245 may be formed in the cut part 240 by separating the covering part 248 from the cut part 240.

In the embodiment of the present invention, a width of one side of the opening 245 is shorter than a width of another side facing the one side, and the other side of the opening 245 may have a round shape. Accordingly, when the container 1 is tipped, materials in the container 1 may be gathered in one side of the opening 245 and discharged, thereby facilitating control of position in which the materials are discharged as well as minimizing a remaining amount of materials in the container 1 after discharging the materials.

The lower connection part 235 connects a lower part of the second coupling part 230 and the auxiliary packing part 255. Further, the packing part 250 is combined with the discharge hole 5 of the container 1 together with the auxiliary packing part 255, thereby preventing materials stored in the container 1 from leaking outside. Specifically, in the embodiment of the present invention, the discharge hole 5 may have a shape bent upwards in a cross-section view, and the auxiliary packing part 255 is spaced away from and faces the packing part 250. Thus, the discharge hole 5 of the container 1 is interposed between the packing part 250 and the auxiliary packing part 255, so that the lower cap 200 may be combined with the discharge hole 5.

Figure 6:
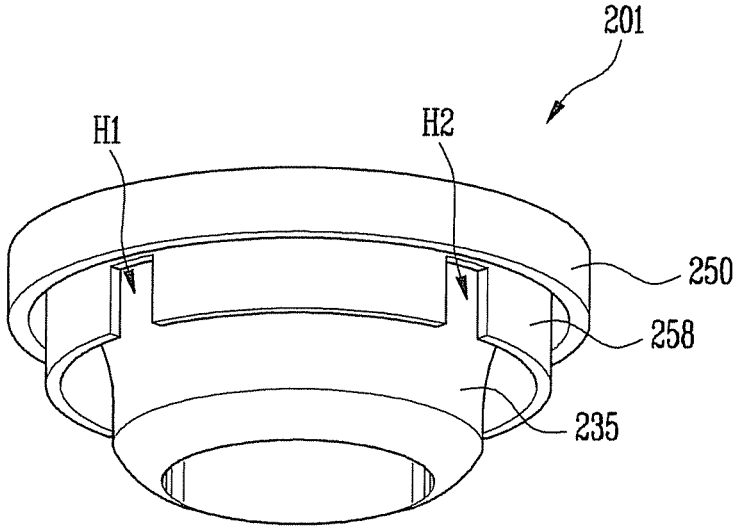
FIG. 6 is a perspective view of a lower cap of a container cap according to another embodiment of the present invention.

FIG. 6 is a perspective view of a lower cap of a container cap according to another embodiment of the present invention. Meanwhile, the container cap according to the other embodiment of the present invention includes the upper cap 100 (FIGS. 1, 2 and 3), described above with reference to FIGS. 1 to 5, and a lower cap 201. Thus, in description of the other embodiment of the present invention with reference to FIG. 6, the upper cap, described in the foregoing embodiment, is not repeatedly depicted.

Referring to FIG. 6, comparing a structure of the lower cap 201 with that of the lower cap 200 (FIGS. 4A, 4B and 5) in the foregoing embodiment, a plurality of holes are formed in an auxiliary packing part 258 included in the lower cap 201.

In the embodiment of the present invention shown in FIG. 6, four holes including a first hole H1 and a second hole H2 may be formed in the auxiliary packing part 258 in total, and in this case a third hole (not shown) may be formed in an opposite position to the first hole H1 and a fourth hole (not shown) may be formed in an opposite position to the second hole H2.

Meanwhile, from a lateral side, the lower cap 201 has a step shape by its components, and a lowest part of the lower cap 201 communicates with the opening. Accordingly, when the container 1 (FIG. 1) is turned upside down to discharge contents stored in the container outside through the opening 245 (FIG. 4A), part of the contents not discharged through the opening may not actively move around the lower cap 201. However, according to the embodiment of the present invention, due to the first to fourth holes, the contents smoothly move between the lower connection part 235 and the auxiliary packing part 258 or between the auxiliary packing part 258 and the packing part 250.

Thus, the first to fourth holes facilitate discharge of the contents from the container, thereby minimizing a remaining amount of contents in the container when discharging the entire contents stored in the container outside.

Meanwhile, although the embodiment of the present invention shown in FIG. 6 illustrates that four holes are formed in total in the auxiliary packing part 258, a greater number of holes may be used or larger-sized holes may be formed depending on a size of the lower cap 201.

Although a few embodiments of the present invention have been shown and described, it would be appreciated by those skilled in the art that changes may be made in this embodiment without departing from the principles and spirit of the invention, the scope of which is defined in the claims and their equivalents.

The invention claimed is:

1. A container cap comprising:

a lower cap combined with a container and comprising an opening communicating with an inside of the container; and an upper cap combined with the lower cap to cover the opening, wherein the upper cap comprises a cover covering the opening; a rim provided around the cover and partly connected to the cover; a connection part connecting the rim and the cover; and a handle connected to the rim and having a round shape, which curves outwards from a center of the cover, viewed on a plane including the top surface of the cover, wherein the handle comprises at least one pair of convex parts each of which curves outwards from the center of the cover, viewed on the plane, and a distance on the plane between an innermost circumferential edge of the at least one pair of convex parts and an outermost circumferential edge of the cover is longer than a distance on the plane between an innermost circumferential edge of the rim and the outermost circumferential edge of the cover.

2. The container cap of claim 1, wherein the rim and the handle are formed in a single body.

3. The container cap of claim 1, wherein a plurality of handles are provided, and each of two handles facing each other among the handles comprises a plurality of convex parts.

4. The container cap of claim 1, wherein a plurality of connection parts are provided, and the connection parts are spaced away from the handles, facing each other.

5. The container cap of claim 1, wherein the upper cap further comprises a first coupling part extending from a lower part of the cover and combined with the lower cap, and the lower cap comprises a cut part formed with the opening; a second coupling part surrounding the cut part and combined with the first coupling part; and a packing part combined with a discharge hole of the container and spaced away from the second coupling part to provide a space into which the first coupling part is inserted.

6. The container cap of claim 5, wherein the upper cap further comprises a first screw thread provided on an inside of the first coupling part, and the lower cap further comprises a second screw thread provided on an outside of the second coupling part and combined with the first screw thread.

7. The container cap of claim 5, further comprising an auxiliary packing part facing the packing part with the discharge hole of the container disposed therebetween, and the discharge hole of the container is interposed between the packing part and the auxiliary part.

8. The container cap of claim 7, wherein the auxiliary packing part comprises holes defined by partly removing the auxiliary packing part.

9. The container cap of claim 1, further comprising a covering part covering the opening.

10. The container cap of claim 9, wherein a width of an open side of the opening is narrower toward one side.

11. The container cap of claim 1, wherein the rim and the handle are bent on the connecting part as an axis in a direction slanting to the cover.

* * * * *